US006862760B2

(12) United States Patent
Bradley et al.

(10) Patent No.: US 6,862,760 B2
(45) Date of Patent: Mar. 8, 2005

(54) DUAL WARMTH LEVEL COMFORTER

(75) Inventors: Christopher W. Bradley, North Yarmouth, ME (US); Gerhard O. Gross, Buxton, ME (US)

(73) Assignee: Bush Equities, Inc., Portland, ME (US)

( * ) Notice: Subject to any disclaimer, the term of this patent is extended or adjusted under 35 U.S.C. 154(b) by 0 days.

(21) Appl. No.: 10/155,441

(22) Filed: May 24, 2002

(65) Prior Publication Data

US 2003/0217411 A1 Nov. 27, 2003

(51) Int. Cl.[7] ..... A47C 9/04
(52) U.S. Cl. ..... 5/486; 5/502; 24/72.5
(58) Field of Search ..... 5/482, 486, 562; 24/72.5, 72.7, 102 P, 575.1, DIG. 32

(56) References Cited

U.S. PATENT DOCUMENTS

| | | | | | |
|---|---|---|---|---|---|
| 1,267,042 | A | * | 5/1918 | Arnold | 5/486 |
| 3,331,088 | A | | 7/1967 | Marquette | |
| 3,508,284 | A | * | 4/1970 | Marquette | 5/486 |
| 3,508,285 | A | | 4/1970 | Marquette | 5/334 |
| 3,530,516 | A | * | 9/1970 | Marquette | 5/486 |
| 4,005,499 | A | * | 2/1977 | Klein | 5/485 |
| 4,229,930 | A | * | 10/1980 | Ostermaier | 54/79.2 |
| 4,573,227 | A | | 3/1986 | Prandina | 5/486 |
| 4,878,258 | A | * | 11/1989 | Casey | 5/420 |
| 5,099,531 | A | * | 3/1992 | Schmier | 5/692 |
| 5,251,350 | A | * | 10/1993 | Bordenave et al. | 5/482 |
| 5,287,573 | A | * | 2/1994 | Ritacco | 5/486 |
| D376,720 | S | | 12/1996 | Thode et al. | D6/603 |
| 5,713,089 | A | | 2/1998 | Ferrante | 5/502 |
| 5,887,299 | A | * | 3/1999 | Phillips | 5/413 R |
| 6,311,347 | B1 | | 11/2001 | Limardi et al. | 5/486 |

* cited by examiner

*Primary Examiner*—Michael Trettel
(74) *Attorney, Agent, or Firm*—Pierce Atwood; Kevin M. Farrell

(57) ABSTRACT

A dual warmth comforter includes first and second sections joined together by a fastening device. The first section includes first and second fabric sheets and a first insulation material disposed between the first and second fabric sheets. The second section includes third and fourth fabric sheets and a second insulation material disposed between the third and fourth fabric sheets. The first section has a first thermal resistance that is greater than the thermal resistance of the second section. The different thermal resistances can be achieved by using different insulation fill weights, insulation materials with different thermal conductivities, or some combination thereof. The fastening device can be hook-and-loop type fasteners, a zipper, buttons, snaps, laces and the like.

7 Claims, 5 Drawing Sheets

DUAL WARMTH LEVEL COMFORTER

BACKGROUND OF THE INVENTION

This invention relates generally to bed coverings and more particularly to comforters used on beds for two occupants.

Conventional comforters are single units constructed of two equally-sized sheets of fabric held together along the outer edges by stitched seams. Interior seams or baffles are often provided to divide a comforter into a series of channels or shaped portions that provide a desired appearance. Comforters are filled with an insulation material such as down, polyester, cotton or the like to increase the warmth level provided to users of the comforter.

It is well known that two people sleeping in the same bed do not necessarily have the same warmth requirements. That is, one occupant may sleep more comfortably with a light covering, while the other occupant would be more comfortable with a warmer covering. Because conventional comforters provide a uniform warmth level over the whole comforter, this difference in warmth requirement results in one of the two occupants being either too warm or too cold while sleeping.

Accordingly, it would be desirable to have a comforter for a two-occupant bed that is adapted to accommodate the different warmth requirements of each individual user.

BRIEF SUMMARY OF THE INVENTION

The above-mentioned need is met by the present invention, which provides a comforter having first and second sections joined together by a means for fastening. The first section includes first and second fabric sheets and a first insulation material disposed between the first and second fabric sheets. The second section includes third and fourth fabric sheets and a second insulation material disposed between the third and fourth fabric sheets. The first section has a first thermal resistance that is greater than the thermal resistance of the second section. The different thermal resistances can be achieved by providing the first section with a greater insulation fill weight than the second section, by using a first insulation material that has a lower thermal conductivity than the second insulation material, or by some combination of differential fill weights and thermal conductivity. The means for fastening can be any device for fastening the two sections together, such as hook-and-loop type fasteners, a zipper, buttons, snaps, laces and the like.

The present invention and its advantages over the prior art will be more readily understood upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
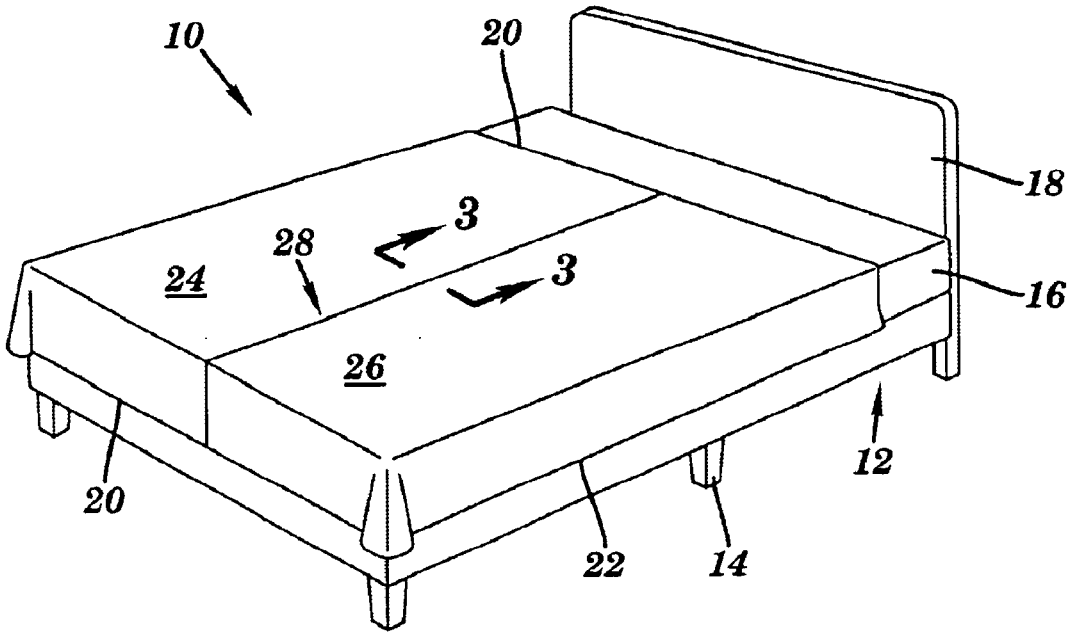
FIG. 1 is a perspective view of a bed having a dual warmth comforter placed thereon.

Referring to the drawings wherein identical reference numerals denote the same elements throughout the various views, FIG. 1 shows a dual warmth comforter 10 placed on an exemplary bed 12 of conventional construction including support structure 14, mattress and spring assembly 16 and a headboard 18. The bed 12 is shown only for purposes of illustration and it should be understood that the comforter 10 could be used with any type of bed configuration. Furthermore, while the comforter of the present invention is primarily intended to be used with a two-occupant bed, such as a queen-sized or king-sized bed, it can be used with beds of any size.

The comforter 10 is generally rectangular in shape so as to have a length and a width. As used herein, the length of the comforter 10 refers the dimension that extends along the head-to-foot length of the bed 12 when the comforter 10 is arranged on the bed 12 in an intended manner, and the width of the comforter 10 refers the dimension that extends across the side-to-side width of the bed 12. Thus, the comforter 10 defines two ends 20 (one adjacent to the head of the bed 12 and the other adjacent to the foot of the bed 12), and two side edges 22 (only one shown in FIG. 1). The length, width and length-to-width ratio of the comforter 10 can vary widely depending on the particular type and size of bed the comforter is intended to be used with.

The comforter 10 also has two opposite sides, one in contact with the bed and the other facing up when the comforter 10 is placed on a bed. The design of the comforter 10 can be such that only one of the two sides is intended to be the side facing up (i.e., the "upper side") or that either side could be the upper side. Furthermore, depending on the use of design features such as a particular ornamental pattern and/or decorative edging, the comforter design could be such that one of the ends 20 would clearly be the top end intended for placement at the head of the bed 12. This would establish one side edge 22 as the right side edge of the comforter 10 and the other side edge 22 as the left side edge for a given upper side. Alternatively, the comforter design could be such that either end 20 could be placed adjacent to the head of the bed 12. This would provide flexibility as to which side edge 22 of the comforter 12 would correspond to a particular side of the bed 12. The present invention is applicable to either situation.

Figure 2:
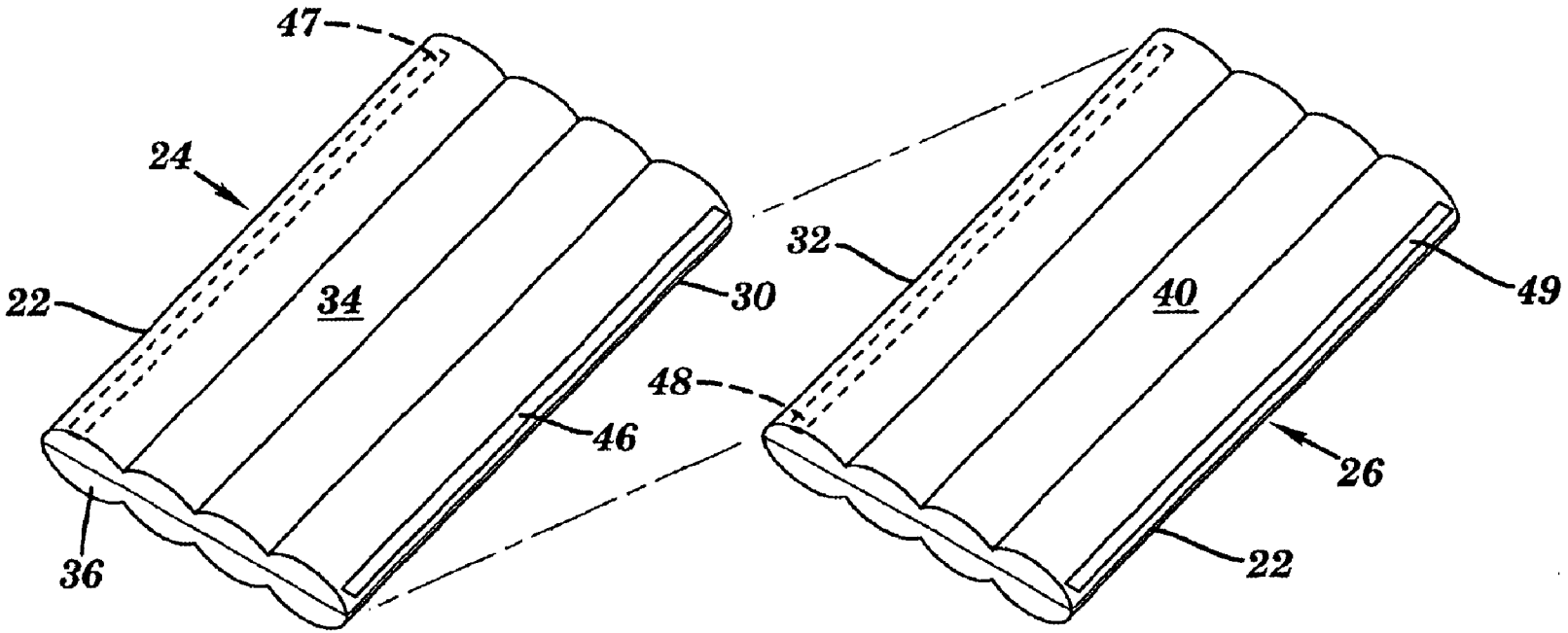
FIG. 2 is an exploded view of the comforter of FIG. 1.
Figure 3:
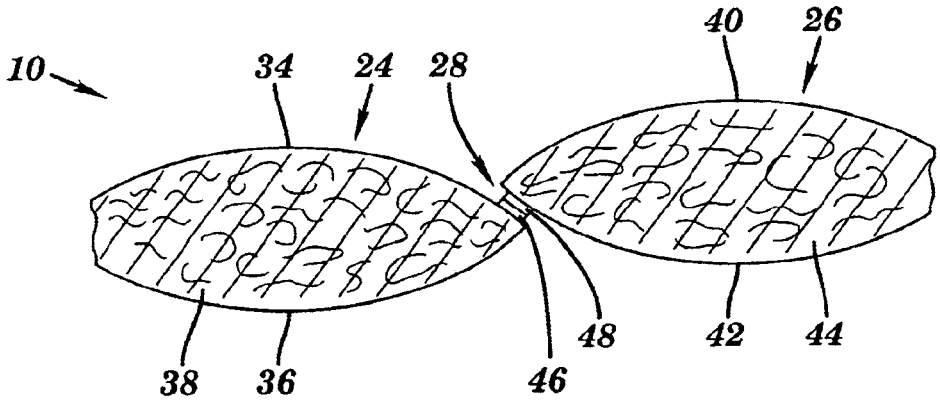
FIG. 3 is a cross-sectional view of the comforter taken along line 3—3 of FIG. 1.

Referring now to FIGS. 1–3, the comforter 10 comprises first and second lengthwise extending sections 24 and 26 releasably fastened together at a joint 28 by any suitable means, which are described in more detail below. Each section 24, 26 is generally rectangular in shape and has an outer side edge that corresponds to the respective comforter side edge 22 and an inner edge 30 or 32. The two inner edges 30, 32 form the joint 28. The two sections 24, 26 are thus fastened together in a side-by-side configuration so that the joint 28 extends between the two ends 20 of the comforter 10, substantially parallel to the side edges 22. Thus, the first and second sections 24, 26 define the left and right sides, respectively, of the comforter 10, although, as discussed above, it should be understood that the first and second sections 24, 26 are not necessarily limited to being on the left or right side. The two sections 24, 26 generally have the same length, which is also the length of the comforter 10. The combined widths of the two sections 24, 26 (except for a small degree of overlap at the joint 28) define the overall width of the comforter 10. It should be noted that while the two sections 24, 26 are preferably provided with substantially equal widths so as to define two equal halves of the comforter 10, it is also possible to provide the sections 24, 26 with different widths so that one side of the comforter 10 is wider than the other.

The first section 24 includes a first fabric sheet 34 and a second fabric sheet 36 that are substantially equally-sized and are stitched together (or otherwise joined) along their outer edges. The first section 24 is filled with a first insulation material 38 between the two sheets 34, 36. Similarly, the second section 26 includes a third fabric sheet 40 and a fourth fabric sheet 42 that are substantially equally-sized and are stitched together (or otherwise joined) along their outer edges. The right section 26 is filled with a second insulation material 44 between the two sheets 40, 42. The insulation materials 38, 44 can be any suitable material, including but not limited to, down, polyester, wool, cotton or the like. As will be described in more detail below the two sections 24, 26 do not necessarily have to have the same type of insulation materials. In addition to the perimeter seams, both sections 24, 26 can include interior stitching to secure the insulation material and provide a desired appearance. Any pattern or design may be selected for the fabric sheets. The sheet designs can be, but need not be, identical.

With this construction, each comforter section 24, 26 has a capacity to impede heat flow (referred to herein as the thermal resistance) that is primarily a function of the fill weight and the thermal conductivity of its insulation material. Specifically, providing a larger insulation fill weight will result in a higher thermal resistance, and using an insulation material with a lesser thermal conductivity will result in a higher thermal resistance. A higher thermal resistance will provide a greater warmth level to the user. In the present invention, the sections 24, 26 are constructed so as to have different thermal resistances and thus provide different warmth levels to individual users of a two-occupant bed. For the purposes of this discussion, the first section 24 will be considered as having a greater thermal resistance than the second section 26, although the reverse could just as easily be the case.

The different thermal resistances can be accomplished in a number of manners. For instance, one possible approach would be to use the same type of material for the insulation materials 38, 44 of the first and second sections 24, 26 but provide the first section 24 with a greater fill weight. Alternatively, the first and second sections 24, 26 could have roughly equal fill weights but the first insulation material 38 could have a lower thermal conductivity than the second insulation material 44. Generally, any combination of fill weights and insulation materials that provides a thermal resistance differential can be selected.

As mentioned above, the two sections 24, 26 are releasably fastened together at a joint 28 by any suitable means. In the illustrative embodiment of FIGS. 1–3, the fastening means is a hook-and-loop type fastener (Velcro). Specifically, the first section 24 has a first strip 46 of hook-and-loop fastener material attached to the first fabric sheet 34 along its inner edge 30, and the second section 26 has a second strip 48 of mating hook-and-loop fastener material attached to the fourth fabric sheet 42 along its inner edge 32. When placed together, the two strips 46, 48 cling to one another to fasten the two sections 24, 26 together. The strips 46, 48 extend substantially the entire end-to-end length of their respective sections 24, 26 and are spaced a small distance from their respective inner edges 30, 32. Thus, when the two sections 24, 26 are fastened together, the inner edges 30, 32 overlap at the joint 28, thereby preventing cold air from penetrating the joint 28.

Figure 4:
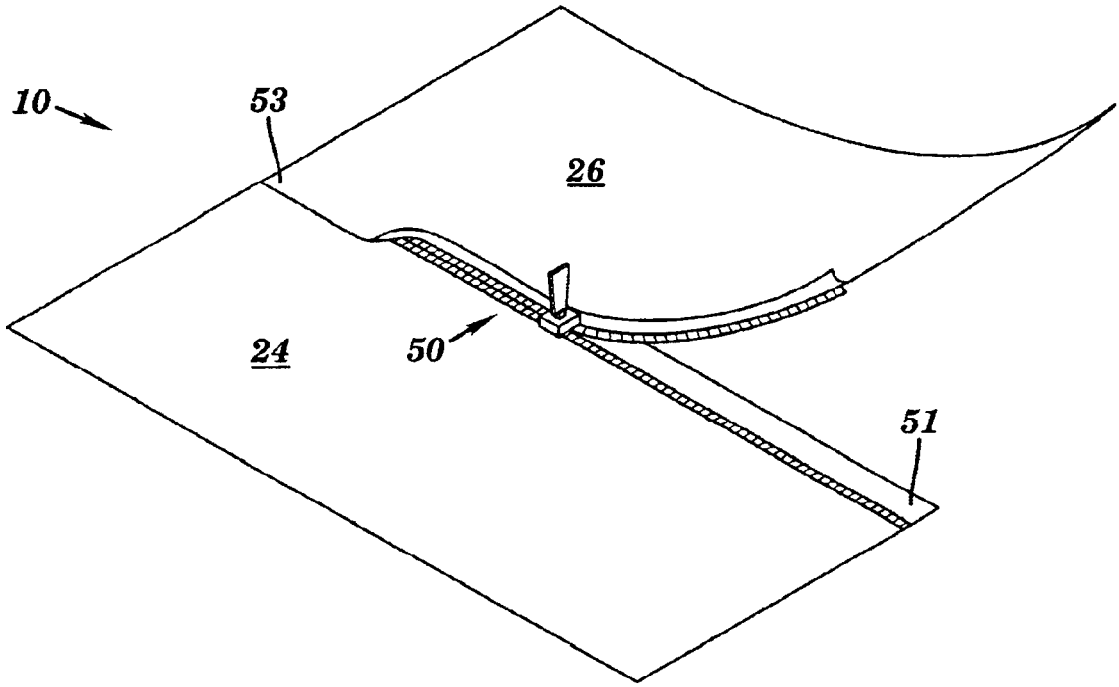
FIG. 4 is a perspective view of an alternative embodiment of a dual warmth comforter.

Many other types of fastening means can be used as an alternative to a hook-and-loop type fastener. For example, FIG. 4 shows a zipper 50 fastening the two sections 24, 26 together. One side of the zipper 50 is attached to the first section 24 along its inner edge 30, and the other side of the zipper 50 is attached to the second section 26 along its inner edge 32. The first section 24 is provided with a first flap 51 along the inner edge 30, and the second section 26 is provided with a second flap 53 along the inner edge 32. The two flaps 51, 53 overlap the zipper 50 on opposite sides of the comforter 10 to prevent cold air from penetrating the joint.

Other possible embodiments include mating snaps spaced along the length of the joint 28, with male snaps attached to one of the two sections 24, 26 and female snaps attached to the other one of the two sections 24, 26, or a series of buttons spaced along the inner edge of one of the two sections 24, 26 and or a series of buttonholes formed along the inner edge of the other one of the two sections 24, 26.

Figure 5:
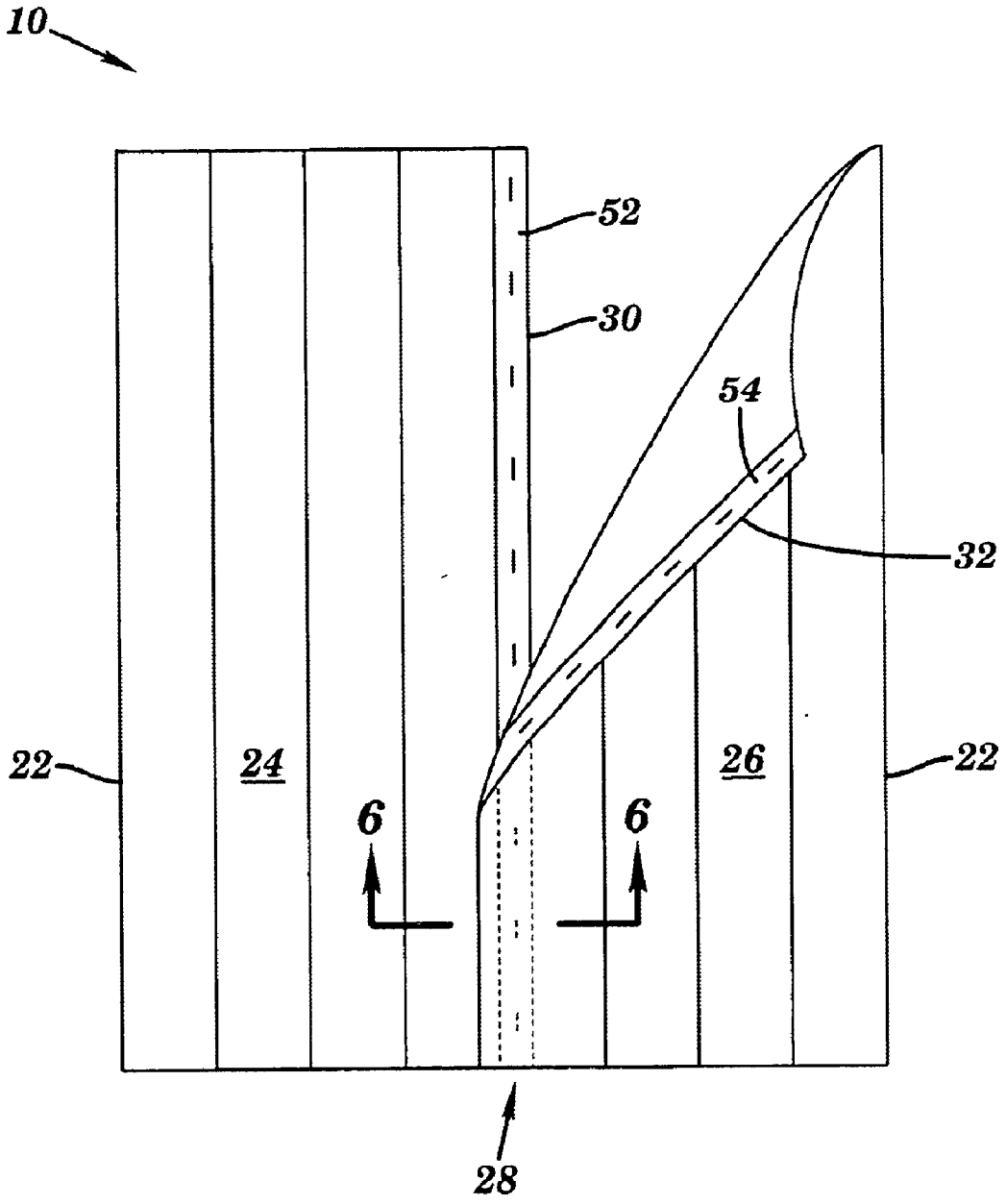
FIG. 5 is a top view of another alternative embodiment of a dual warmth comforter.
Figure 6:
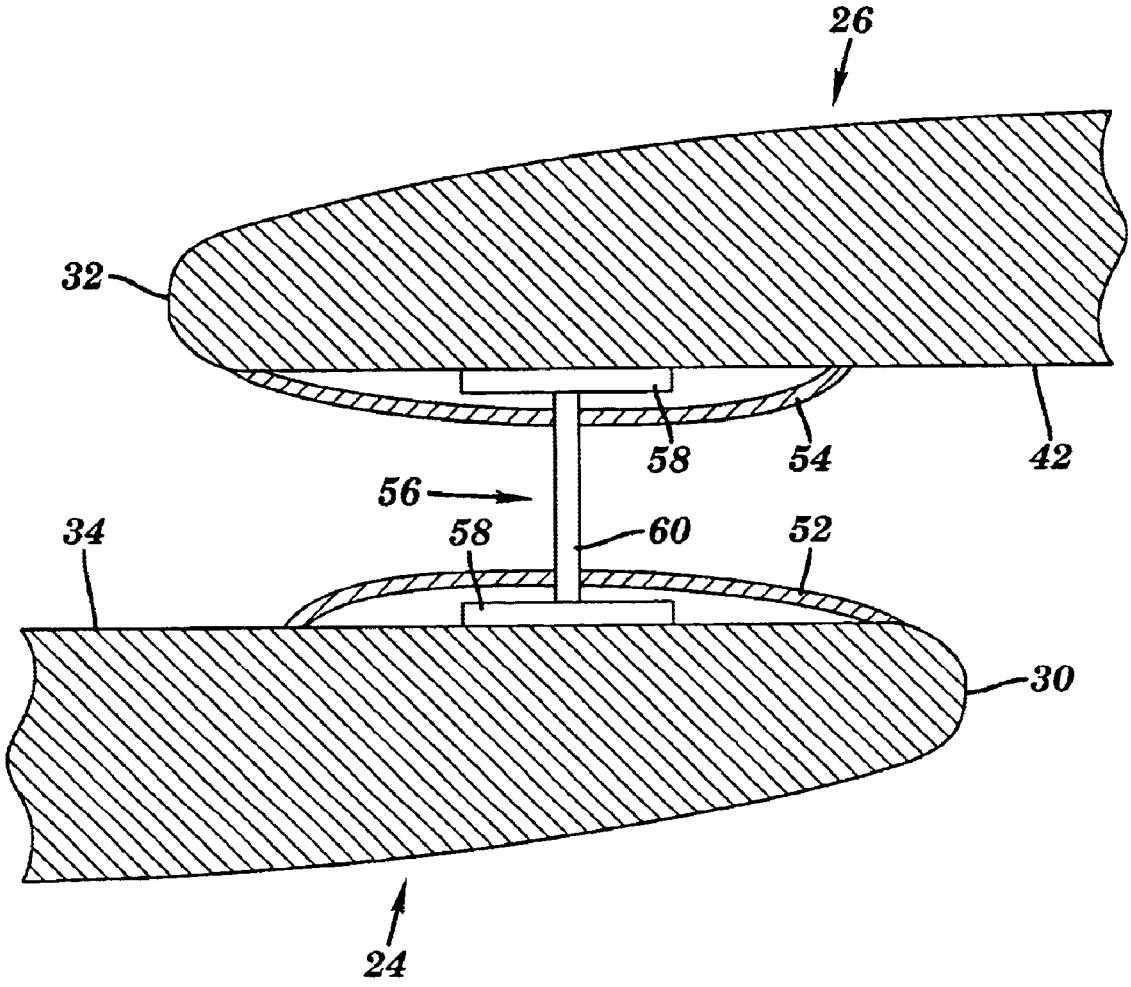
FIG. 6 is a cross-sectional view of the comforter taken along line 6—6 of FIG. 5.

Referring to FIGS. 5 and 6, another alternative fastening means is shown. In this case, the first section 24 has a first fabric strip 52 that is attached to the first fabric sheet 34 along its inner edge 30 and has a row of buttonholes formed therein. The second section 26 has a second fabric strip 54 that is attached to the fourth fabric sheet 42 along its inner edge 32 and has a row of buttonholes formed therein. A plurality of fasteners 56 are inserted into corresponding buttonholes of the two fabric strips 52, 54 to fasten the two section 24, 26 together. Each fastener 56 includes two buttons 58 joined by a link 60. The fasteners 56 thus function in a manner similar to a cuff link in which one of the two buttons 58 is inserted in the buttonhole of the first fabric strip 52 and the other one of the two buttons 58 is inserted into the corresponding buttonhole of the second fabric strip 54. The fabric strips 52, 54 extend substantially the entire end-to-end length of their respective sections 24, 26. Each row of buttonholes is spaced a small distance from its respective inner edge 30, 32 to provide an overlap at the joint 28.

This arrangement does not utilize a male-female connection and thus permits interchangeability between a large number of comforter sections. That is, any given comforter section could be joined to another comforter section as either the left side or right side of the comforter. This avoids the need of having one section that is only the left section and another section that is only a right section. A benefit of this arrangement is that by providing three comforter sections of varying levels (high warmth level, moderate warmth level and low warmth level), the comforter could be easily adapted for year round use. For example, during the winter, the comforter would be configured so that the high warmth section would be on the side of the bed that the user desiring a warmer covering normally occupies and the moderate warmth section would be on the side of the bed that the user desiring a lighter covering normally occupies. During the summer, the comforter would be configured so that the moderate warmth section would be on the side of the bed that the user desiring a warmer covering normally occupies and the low warmth section would be on the side of the bed that the user desiring a lighter covering normally occupies.

This avoids the need of having two completely different comforters for the winter and summer.

This advantage can also be obtained with other types of fastening means. Referring again to FIG. 2, the first section 24 can optionally be provided with a third strip 47 of hook-and-loop fastener material attached to the second fabric sheet 36 along its side edge 22, and the second section 26 can optionally be provided with a fourth strip 49 of hook-and-loop fastener material attached to the third fabric sheet 40 along its side edge 22. The first and third strips 46 and 47 would be opposite types of hook-and-loop fastener material, as would the second and fourth strips 48 and 49. With two distinct types of hook-and-loop fastener materials on opposing sides, each comforter section would be interchangeable and not limited to being a left or right side section. This interchangeability could also be accomplished by using multiple zippers or other types of fasteners on both sides of each section.

Other advantages of the present invention is that the dual warmth comforter does not require special comforter covers and will work with conventional covers. Also, because the sections are releasably fastened, an individual section can be used as a conventional, single warmth comforter on a twin-sized bed.

While specific embodiments of the present invention have been described, it will be apparent to those skilled in the art that various modifications thereto can be made without departing from the spirit and scope of the invention as defined in the appended claims.

What is claimed is:

1. A comforter comprising:

a first section including first and second fabric sheets and a first insulation material disposed between said first and second fabric sheets, said first section having a first thermal resistance;

a second section including third and fourth fabric sheets and a second insulation material disposed between said third and fourth fabric sheets, said second section having a second thermal resistance, wherein said first thermal resistance is greater than said second thermal resistance; and means for fastening said first section to said second section, said means for fastening including a first strip of material attached to said first fabric sheet along a first edge of said first section and having a first row of buttonholes formed therein, a second strip of material attached to said fourth fabric sheet along a first edge of said second section and having a second row of buttonholes formed therein, and a plurality of fasteners inserted into corresponding buttonholes of said first and second strips to fasten said first and second sections together so that a portion of each fastener is disposed between said first strip of material and said first fabric sheet and another portion of each fastener is disposed between said second strip of material and said fourth fabric sheet.

2. The comforter of claim 1 wherein each one of said fasteners includes two buttons joined by a link.

3. The comforter of claim 1 wherein said first section has a greater insulation fill weight than said second section.

4. The comforter of claim 1 wherein said first insulation material has a lower thermal conductivity than said second insulation material.

5. The comforter of claim 1 wherein said first and second strips of material are situated on said first and second sections, respectively, so that said first and second sections overlap one another when fastened together.

6. The comforter of claim 1 wherein said first and second sections are substantially identical structurally other than said first thermal resistance being greater than said second thermal resistance.

7. The comforter of claim 1 wherein said first section includes a second edge opposite said first edge of said first section and said second section includes a second edge opposite said first edge of said second section, and wherein said second edge of said first section and said second edge of said second section are both free of fastening means.

* * * * *